US005610126A

United States Patent [19]

Barford et al.

[11] Patent Number: 5,610,126

[45] Date of Patent: Mar. 11, 1997

[54] LAVATORY CLEANSING COMPOSITIONS

[75] Inventors: Eric D. Barford, Stanton; Peter J. Clark, Tring; John Marshall, Norwich; Daniel J. Jeffrey, Thetford, all of England

[73] Assignee: Jeyes Group Limited, Norfolk, England

[21] Appl. No.: 466,119

[22] Filed: Jun. 6, 1995

Related U.S. Application Data

[63] Continuation of Ser. No. 307,097, Sep. 16, 1994, which is a continuation of Ser. No. 158,801, Nov. 19, 1993, which is a continuation of Ser. No. 22,424, Feb. 16, 1993, which is a continuation of Ser. No. 821,144, Jan. 16, 1992, which is a continuation of Ser. No. 667,253, Mar. 11, 1991, which is a continuation of Ser. No. 524,713, May 17, 1990, which is a continuation of Ser. No. 338,400, Mar. 13, 1989, which is a continuation of Ser. No. 165,342, Feb. 26, 1988, which is a continuation of Ser. No. 874,060, Jun. 13, 1986.

[30] Foreign Application Priority Data

Jun. 14, 1985 [GB] United Kingdom ..... 8515181

[51] Int. Cl.[6] ..... C11D 3/395; C11D 3/02

[52] U.S. Cl. ..... 510/191; 510/192; 510/379; 510/381

[58] Field of Search ..... 252/90, 94, 134, 252/174, 186.25, 186.34, 186.35, 186.36, 186.37, 187.1, 187.53, 187.34; 510/191, 192, 379, 381, 440; 134/42

[56] References Cited

U.S. PATENT DOCUMENTS

| | | | |
|---|---|---|---|
| 4,219,436 | 8/1980 | Gromer et al. | 252/135 |
| 4,224,266 | 9/1980 | Hunt et al. | 252/134 |
| 4,428,872 | 1/1984 | Callicott | 252/550 |
| 4,532,063 | 7/1985 | Gueldenzopf | 252/90 |
| 4,537,697 | 8/1985 | Girard | 252/90 |
| 4,578,207 | 3/1986 | Holdt et al. | 252/134 |
| 4,729,845 | 3/1988 | Altenschoepfer et al. | 252/99 |

FOREIGN PATENT DOCUMENTS

| | | | |
|---|---|---|---|
| 2021143 | 11/1979 | United Kingdom | 252/DIG. 16 |

*Primary Examiner*—Paul Lieberman
*Assistant Examiner*—Kery A. Fries
*Attorney, Agent, or Firm*—Watson Cole Stevens Davis, P.L.L.C.

[57] ABSTRACT

A lavatory cleansing block is formed of a composition comprising a mixture of (A) a surface active component comprising one or more anionic surface active agents and (B) a halogen release agent component consisting of (i) a halogen release agent selected from N-chloro-succinimide, calcium hypochlorite, chloramine T, dichlorodimethylhydantoin and bromochlorodimethylhydantoin, and, optionally, (ii) another halogen release agent, in which the halogen release component forms from 10 to 65% by weight of the composition, halogen release component (i) forms not less than 5% by weight of the composite and halogen release component (ii), when present, forms not more than 30% by weight of the block.

12 Claims, No Drawings

LAVATORY CLEANSING COMPOSITIONS

This application is a Continuation of application Ser. No. 08/307,097, filed Sep. 16, 1994 which is a Continuation of application Ser. No. 08/158,801 filed Nov. 19, 1993; which is a Continuation of application Ser. No. 08/022,424 filed Feb. 16, 1993; which is a Continuation of application Ser. No. 07/821,144 filed Jan. 16, 1992; which is a Continuation of application Ser. No. 07/667,253, filed Mar. 11, 1991; which is a Continuation of application Ser. No. 524,713, filed May 17, 1990, which is a Continuation of application Ser. No. 338,400, filed Mar. 13, 1989, which is a Continuation of application Ser. No. 165,342, filed Feb. 26, 1988, which is a Continuation of application Ser. No. 874,060, filed Jun. 13, 1986.

This invention is concerned with improvements in and relating to lavatory cleansing compositions.

In particular, the present invention is concerned with solid lavatory cleansing compositions intended to be brought into contact with the flush water of a lavatory or urinal whereby a part of the composition is dissolved in the flush water to release active ingredients thereto for cleaning the lavatory or urinal. Thus, the solid composition may be immersed in the water cistern of a lavatory or urinal, either as a free-standing block or as a block in a container or dispensing device adapted to deliver a more or less metered dose of liquid containing dissolved active material to the water in the cistern, so that water containing the active material is delivered to the lavatory bowl or urinal on flushing. Alternatively, the composition may be a solid block contained in a dispensing device mounted in the path of flushed water, e.g. under the rim of a toilet bowl, whereby it comes into contact with the flush water on flushing.

One common class of component of such known lavatory cleansing compositions comprises one or more water-soluble surface active agents. Another desirable component of such compositions would be a halogen release agent, that is a compound which on contact with water releases hypohalous acid and/or hypohalite ions to the water, since these are powerful sanitising and cleansing agents. In principle, there would appear to be no problem in combining these two classes of ingredient in a single composition. However, halogen release agents are, by their nature, powerful chemically reactive species, serving as halogenating or oxidising agents. Thus, in practice, we have found that halogen release agents (i) tend to react with surface active materials and/or (ii) tend, when moistened, to evolve gas thereby losing their activity and, in many cases, destroying the physical integrity of the cleansing composition. This is particularly the case for free-standing blocks for immersion in the cistern of a lavatory but is also a marked disadvantage for solid lavatory cleansing composition blocks employed in other ways. Further, halogen release agents may attack component parts of lavatories, urinals or their cisterns.

We have now found, in accordance with the present invention, that the use of certain surface active agents together with certain halogen release agents makes possible the preparation of lavatory cleansing compositions of improved properties in respect of the above problems.

According to the invention, therefore, there is provided a solid lavatory cleaning block formed of a composition comprising a mixture of (A) a surface active component comprising one or more anionic surface active agents and (B) a halogen release agent component consisting of (i) a halogen release agent selected from N-chlorosuccinimide, calcium hypochlorite, chloramine T, dichlorodimethylhydantoin and bromochlorodimethylhydantoin, and, optionally, (ii) another halogen release agent, in which the halogen release component forms from 10 to 65% by weight of the composition, halogen release component (i) forms not less than 5% by weight of the composite and halogen release component (ii), when present, forms not more than 30% by weight of the block.

Suitable anionic surface active agents for use in the blocks of the invention include alkali metal, typical sodium, paraffin sulphonates; alkali metal alkyl sulphates and alkali metal alkyl aryl sulphonates, especially alkali metal benzene sulphonates. A typical example is sodium dodedecyl benzene sulphonate which is a readily available material of commerce. The anionic surface active component of the block suitably forms from 5 to 75% by weight of the composition, and especially from 20 to 60% by weight thereof.

The halogen release component of the block comprises one of N-chlorosuccinimide, calcium hypochlorite, chloramine T, dichlorodimethyl hydantoin and bromochlorodimethylhydantoin. Of these, which may be termed the principal halogen release agents of the compositions of the invention, N-chlorosuccinimide is generally preferred. Other, secondary, halogen-release agents may also be present in the compositions. Examples of such secondary halogen release agents include chlorinated isocyanuric acid derivatives, such as sodium dichloroisocyanurate and trichloroisocyanuric acid, and chlorinated sodium tripolyphosphate.

The total halogen release component, that is principal halogen release agent and secondary halogen release agent, if any, is present in the compositions of the invention in amounts of from 10 to 65% by weight, preferably from 10 to 50% by weight, more preferably from 20 to 40% by weight.

The principal halogen release agent should be present in the composition in an amount of at least 5% by weight, preferably at least 10% by weight. The secondary halogen release agent should be present in an amount of not more than 30% by weight.

Other components may, and often will, be present in the compositions of the invention. Indeed, in certain cases such other compounds will be virtually essential. Thus, for example, in the case of compositions intended for free-standing blocks, a compound of lower solubility than the anionic surface active component and which assists in controlling the rate of dissolution of the block, is suitably present. The presence of such less soluble agents may also be of advantage when the composition is to be put up in a dispensing container though in such a case the design of the container may be such as to provide for only limited contact of water with the composition and thus the presence of a less soluble agent may well not be required.

As will be appreciated, any other ingredient present in the composition of the invention should be resistant to attack by a halogen release agent. Thus, for example, most dyestuffs commonly employed in lavatory cleansing compositions to impart a pleasant colouration to the flush water are not sufficiently resistant to halogen release agents with the results that (a) the dyestuffs are decolourised or discoloured to an unpleasant colour and (b) available halogen, which would otherwise serve as a sanitizing agent, is lost. Similarly, most perfumes which are commonly employed in lavatory cleansing compositions are also subject to attack by halogen release agents.

Turning to specific classes of other ingredients which may be present in the compositions of the invention there may be firstly mentioned the compounds of reduced solubility as compared with the anionic surface active agents which may, indeed, may be virtually wholly insoluble in water. Such agents should be resistant to attack by the halogen release component, both in the composition and in aqueous solutions produced by dissolution of the composition in use. It is a matter of simple experiment to determine whether any candidate is so resistant. Generally, the solubility control agent should be a saturated organic material. Examples of less soluble agents which may be employed include polyethylene waxes; low ethoxylates (e.g. containing up to 4 ethylene oxide units per mole) of fatty alcohols and alkylphenols; and paradichlorobenzene.

The amount of less soluble agent can vary within wide limits and, when present, it suitably forms up to 50% by weight of block, generally from 2 to 25% by weight thereof.

Certain of the less soluble agents noted above, the ethoxylated fatty alcohols and alkyl phenols, also possess surface active properties and thus may contribute to the overall cleansing effect of a composition containing them. In this connection it may be noted that other nonionic surfactants may be present in the compositions of the invention but that these should be present in lesser amounts than the anionic surface active agent component.

Other components which may be present in the compositions of the invention are inert fillers such as sodium sulphate and water softening agents such as sodium polyphosphates. These are suitably present, in total, in amounts of upto 50% by weight of the composition, generally amounts of from 5 to 30% by weight thereof. Commercially available anionic surface active agents often contain appreciable amounts of filler or diluent, such as sodium sulphate, and such commercially available materials may be used in formulating compositions in accordance with the invention to provide both the desired surface active component and some or all of the filler.

Lavatory cleansing compositions generally contain a germicide or preservative but this is not generally necessary in the case of the compositions of the invention since they already contain powerful germicides, namely the halogen release agents.

As noted above, it is not generally possible to incorporate dyestuffs or perfumes in the compositions of the invention. However, some insoluble pigments are resistant to halogen release agents and may be incorporated in the compositions of the invention to impart a colouration to the flush water. Examples of suitable pigments include copper phthalocyanine pigments which can be conveniently incorporated in the compositions of the invention in the forms of dispersions in suitable media. When such pigments are used in the compositions of the invention they are suitably present in amounts of up to 20% to by weight, preferably from 1 to 15%, more preferably 1 to 10% by weight.

A further possible ingredient of the composition of the invention is a water-soluble salt of a polyvalent metal, especially a salt of calcium or magnesium. Thus, we have found that lavatory cleansing compositions containing an anionic surfactant have different dissolution rates in hard and soft water, being more rapidly dissolved in soft water. This problem may be overcome by incorporating a water-soluble salt of a polyvalent metal in the composition, suitably in an amount of from 0.5 to 25% by weight, preferably from 5 to 15% by weight. The salt is preferably non-deliquescent and a particularly suitable salt is magnesium sulphate. If the principal halogen release agent is calcium hypochlorite then this may in itself serve as a polyvalent metal salt and hence there may be no need to incorporate further polyvalent metal salt.

The compositions of the invention are suitably formed by a compression process, especially an extrusion process comprising the steps of forming a mixture of the components of the composition, extruding this mixture into rod or bar form and then cutting the extruded rod or bar into appropriately sized pieces or blocks. (In this connection it may be noted that a free standing lavatory cleansing block suitably has a weight of from 20 to 150 gms preferably from 30 to 100 gms).

When an extrusion process is employed the mixture to be extruded should contain up to 25% by weight, preferably from 3 to 15% by weight, of a liquid component or a solid component which is liquefied under extrusion conditions to act as a processing aid. In the case of the compositions of the invention this is conveniently provided by the use of a liquid less-soluble agent such as a lower ethoxylated alcohol or alkyl phenol.

In order that the invention may be well understood the following examples are given by way of illustration only.

EXAMPLES

Free-standing lavatory cleansing blocks were produced by extruding the mixtures listed in the following table into rod form and cutting the rod in blocks of about 70 g.

TABLE

| Example | Anionic surface active agent (% by wt.) | Halogen release agent(s) (% by wt.) | Others (% by wt.) |
|---|---|---|---|
| 1 | Na DBS (50) | NCS (15)<br>Na DCIC (15) | $NP(EO)_4$ (7)<br>$Na_2SO_4$ (13) |
| 2 | Na DBS (50) | NCS (18)<br>Na DCIC (12) | $NP(EO)_4$ (7)<br>$Na_2SO_4$ (13) |
| 3 | Na DBS (50) | NCS (20)<br>Na DCIC (10) | $NP(EO)_4$ (8)<br>$Na_2SO_4$ (12) |
| 4 | Na DBS (50) | DCDMH (18)<br>Na DCIC (12) | $NP(EO)_4$ (8)<br>$Na_2SO_4$ (12) |
| 5 | Na DBS (52) | NCS (18)<br>Na DCIC (12) | $NP(EO)_4$ (8)<br>$MgSO_4$ (10) |
| 6 | Na DBS (56.5) | NCS (15)<br>Na DCIC (10) | $NP(EO)_4$ (8)<br>$MgSO_4$ (10)<br>Na stearate (0.5) |
| 7 | Na DBS (52) | NCS (18)<br>Na DCIC (12) | $MgSO_4$ (10)<br>$NP(EO)_2$ (8) |
| 8 | Na DBS (52) | NCS (30) | $NP(EO)_4$ (8)<br>$MgSO_4$ (10) |
| 9 | Na DBS (32)<br>SLS (20) | NCS (18)<br>Na DCIC (12) | $NP(EO)_4$ (8)<br>$MgSO_4$ (10) |
| 10 | SAS (52) | NCS (18)<br>Na DCIC (12) | $NP(EO)_4$ (8)<br>$MgSO_4$ (10) |
| 11 | SAS (52) | Chloramine T (30) | $NP(EO)_4$ (8)<br>$MgSO_4$ (10) |
| 12 | SAS (52) | Chloramine T (18)<br>Na DCIC (12) | $NP(EO)_4$ (8)<br>$MgSO_4$ (10) |
| 13 | SAS (55) | Chloramine T (18)<br>NCS (12) | $NP(EO)_4$ (5)<br>$MgSO_4$ (10) |
| 14 | NADBS (50) | CaOCl (30) | A $(EO)_3$ (8)<br>$Na_2SO_4$ (12) |
| 15 | NADBS (58) | NCS (12)<br>TCIC (12) | $NP(EO)_1$ (8)<br>$MgSO_4$ (10) |
| 16 | NADBS (56) | NCS (12)<br>DCDMH (18) | $NP(EO)_4$ (8)<br>$MgSO_4$ (10) |
| 17 | NADBS (58) | BCDMH (20) | $NP(EO)_3$ (8)<br>NaCl (10) |

Notes:
NADBS — sodium dodeyl benzene sulphonate used as Nansa HS 805, a commercial product containing about 80% by weight of active sulphonate and a balance comprising mainly sodium sulphate.
NCS — N-chlorosuccinimide
NADCIC — sodium dichloroisocyanurate
$NP(EO)_4$ ethoxylated nonyl phenol containing an average of four ethyleneoxy units per molecule.
SLS — sodium lauryl sulphate
SAS — random secondary alkane sulphonate sold under trade name "Hostapur SAS 93".

TABLE-continued

| Example | Anionic surface active agent (% by wt.) | Halogen release agent(s) (% by wt.) | Others (% by wt.) |
|---|---|---|---|

$A(EO)_3$ — ethoxylated alkanol ($C_{13}/C_{15}$) containing an average of three ethoxyleneoxy units per molecule.
TCIC — trichloroisocyanuric acid
$NP(EO)_1$ — ethoxylated nonyl phenol containing an average of one ethyleneoxy unit per molecule.
BCDMH — bromochlorodimethylhydantoin.

We claim:

1. A method of cleansing a lavatory comprising dosing at each flush a metered amount of dissolved active material from a solid lavatory cleansing block formed of a composition comprising a mixture of from 5 to 75% by weight of (A) a surface active component comprising at least one anionic surface active agent and from 10 to 65% by weight of (B) a halogen release component selected from the group consisting of a first halogen release agent and a mixture of a first and second halogen release agent, said first halogen release agent being N-chlorosuccinimide, said second halogen release agent being selected from the group consisting of sodium dichloroisocyanurate, trichloroisocyanuric acid and chlorinated sodium tripolyphosphate, said N-chlorosuccinimide being present in the composition in an amount of at least 5% by weight and said second halogen release agent being present in the composition in an amount of from 0 to 30% by weight.

2. The method as claimed in claim 1 in which the anionic surface active agent is selected from alkali metal paraffin sulphonates, alkali metal alkyl sulphates and alkali metal alkyl aryl sulphonates.

3. The method as claimed in claim 1 in which the halogen release component (B) forms from 10 to 50% by weight of the composition.

4. The method as claimed in claim 1 in which N-chlorosuccinimide forms at least 10% by weight of the composition.

5. The method as claimed in claim 1 in which the second halogen release agent is sodium dichloroisocyanurate.

6. The method as claimed in claim 1 in which the composition also contains one or more agents of lower solubility than the anionic surface active agent in an amount of from 2 to 25% by weight, processing aids in an amount of from 3 to 15% by weight, inert fillers in an amount of from 5 to 30% by weight, water-softening agents in an amount of from 0.5 to 25% by weight and pigments in an amount of from 1 to 15% by weight.

7. A solid lavatory cleansing block for positioning standing free or in a container in a cistern of a lavatory or urinal or in a container in the path of flushing water formed of a composition comprising a mixture of from 5 to 75% by weight of (A) a surface active component comprising at least one anionic surface active agent and from 10 to 65% by weight of (B) a halogen release component selected from the group consisting of a first halogen release agent and a mixture of a first and second halogen release agent, said first halogen release agent being N-chlorosuccinimide, said second halogen release agent being selected from the group consisting of sodium dichloroisocyanurate, trichloroisocyanuric acid and chlorinated sodium tripolyphosphate, said N-chlorosuccinimide being present in the composition in an amount of at least 5% by weight and said second halogen release agent being present in the composition in an amount of from 0 to 30% by weight.

8. The block of claim 7 wherein the anionic surface active agent is selected from alkali metal paraffin sulphonates, alkali metal alkyl sulphates and alkali metal alkyl aryl sulphonates.

9. The block of claim 7 wherein the halogen release component (B) forms from 10 to 50% by weight of the composition.

10. The block of claim 7 wherein N-chlorosuccinimide forms at least 10% by weight of the composition.

11. The block of claim 7 wherein the second halogen release agent is sodium dichloroisocyanurate.

12. The block of claim 7 wherein the composition also contains one or more agents of lower solubility than the anionic surface active agent in an amount of from 2 to 25% by weight, processing aids in an amount of from 3 to 15% by weight, inert fillers in an amount of from 5 to 30% by weight, water-softening agents in an amount of from 0.5 to 25% by weight and pigments in an amount of from 1 to 15% by weight.

* * * * *